United States Patent [19]

Chang

[11] Patent Number: 4,505,171

[45] Date of Patent: Mar. 19, 1985

[54] FOLDABLE CROSS WRENCH

[76] Inventor: Chung-Hsing Chang, No. 70-3, Fong-Kuo Rd., Changhwa City, Taiwan

[21] Appl. No.: 516,876

[22] Filed: Jul. 25, 1983

[51] Int. Cl.[3] ..... B25B 13/00

[52] U.S. Cl. ..... 81/177 B

[58] Field of Search ..... 81/177 B, 177 E, 440; 7/100

[56] References Cited

U.S. PATENT DOCUMENTS

| | | | |
|---|---|---|---|
| 2,738,694 | 3/1956 | Boatright | 81/177 B |
| 2,939,351 | 6/1960 | Falk | 81/177 B |
| 3,587,366 | 6/1971 | Klein | 81/177 B |
| 4,236,266 | 12/1980 | Hannah et al. | 81/177 B X |

FOREIGN PATENT DOCUMENTS

| | | | |
|---|---|---|---|
| 1259800 | 1/1968 | Fed. Rep. of Germany | 81/440 |
| 1240971 | 8/1960 | France | 81/177 B |

*Primary Examiner*—James G. Smith

*Attorney, Agent, or Firm*—Barlow & Barlow

[57] ABSTRACT

The foldable cross wrench has four wrench members pivoted to a coupling member the wrench members can be stretched into a cross shape, and secured in stretched position by a cap member which is provided with keys to engage with key ways on the wrench members. When the wrench is not used, the cap member is rotated to a position where the keys are not engaged with the key ways on wrench members so that the wrench members can be pivoted to a folded position.

4 Claims, 4 Drawing Figures

FOLDABLE CROSS WRENCH

BACKGROUND OF THE INVENTION

This invention relates to cross wrench and more particularly to foldable cross wrench wherein a coupling means is included to enable the folding of the wrench body when not used.

Wrenches are one of the most important and most-used tools in a mechanic's kit for loosening or tightening bolts and nuts. Among them a cross wrench specifically designed for some special applications is at a disadvantage by its large dimensions, which will occupy a large space when stored and not convenient to be carried. Some improvement has been made before this invention, for example, a cross wrench including two levers each with work head at two ends thereof, which are pivoted at the intersection point can be pivoted to align one above the other. However, this construction still occupies relative large space when stored away.

SUMMARY OF THE INVENTION

Accordingly, it is a primary object of this invention to provide a foldable cross wrench which needs only a small space for storing it away.

It is another object of this invention to provide a foldable cross wrench including a folding mechanism, which can bear a torque not less than the known unfoldable cross wrench.

With these and other objects in view, the present invention contemplates a foldable cross wrench which comprises a coupling member including a rigid plate which is quartered into four connected sections, each two adjacent sections have a slot, the top surface of each section being provided with a first key way positioned on a circle which has a radius corresponding to the distance between the central axis of the coupling member and the key ways. Four wrench members each having a working head at a first end have a second end pivoted to the coupling member between two adjacent sections and received in the slot, the second end being provided with a second key way which constitutes a circular key way with the first key way when the wrench members are in stretched position. A cap member is releasably attached to the coupling member, and is provided with four key elements on the bottom surface thereof for locking the wrench members in stretched position by engaging the second key way. The wrench members may be released as the cap member is rotated through a predetermined angle to a position where the key elements disengage with the first key ways. A headed bolt having a threaded end, is inserted through the cap member and the coupling member and a nut screwed thereon to fasten the cap and coupling members together.

A further feature of the invention resides in that an extended bore is provided at the pivoting end of each wrench member for receiving a pin to pivot on the coupling member and permit a limited longitudinal movement with respect to the coupling member.

To prevent the headed bolt from rotating with the nut, a third key way on the upper surface of the cap member and a corresponding third key are separately provided on the bottom surface of the head of the bolt for securing the headed bolt with the cap member.

Other objects, advantages and features of the invention may be apparent upon consideration of the following detailed description when read in conjunction with the accompanying drawings wherein:

DETAILED DESCRIPTION OF THE PREFERRED EMBODIMENT

Figure 1:
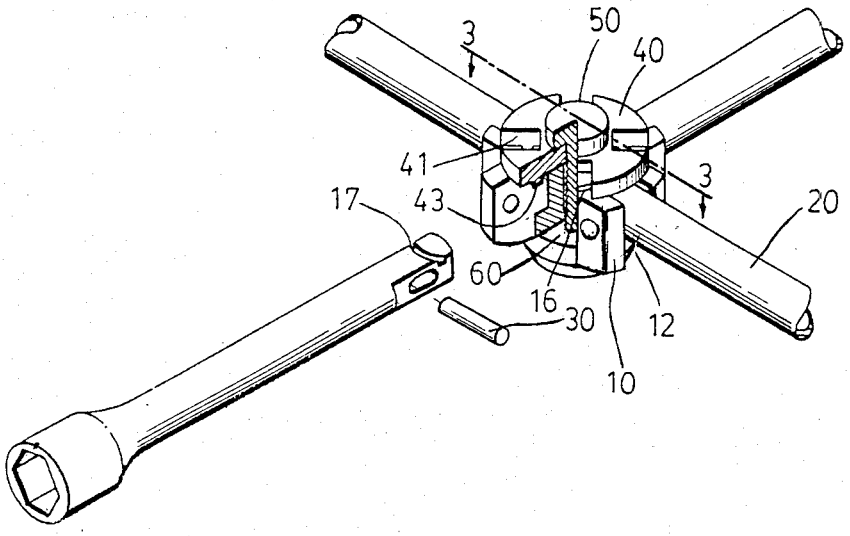
FIG. 1 is a schematic fragmentary perspective view of the foldable cross wrench according to the present invention.

Referring to FIG. 1, the coupling member 10 consists of a rigid block which is quartered into four identical sections connected intergrally by a bottom plate. Between each two adjacent sections, there is provided a channel 12 for receiving one end of a wrench member 20 which is pivoted to walls of the adjacent sections.

Figure 3:
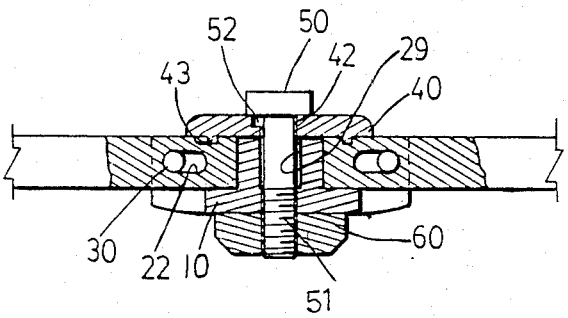
FIG. 3 is a section view taken on line 3—3 of FIG. 1 with the wrench members in a stretched position.

As best seen in FIG. 3, an extended bore 22 is provided at one end of the wrench member 20 for inserting a pin 30 to pivot the wrench member 20 to the coupling member 10 while permitting a limited movement of the wrench member 20 in the pivoted position, the benefit of which will described detailedly hereinafter.

Figure 4:
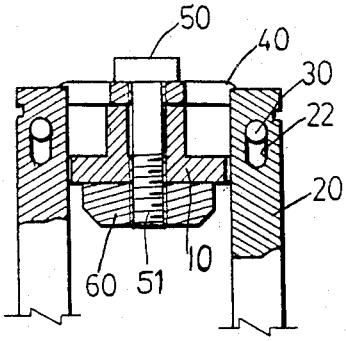
FIG. 4 is a section view taken on line 4—4 of FIG. 2 with a wrench members in a folded position.

A cap member 40, as shown in FIG. 1 and FIG. 3, is formed as a notched circular plate having keys 43 provided on the bottom surface thereof. The notches 41 are distributed corresponding to the channels between each two adjacent sections of the coupling member 10 so that when a folded position is taken as shown in FIG. 4, the notches 41 are aligned with the channels to allow the pivoting end of the wrench member 20 to longitudinally extend therein.

The top surface of the coupling member 10 and the pivoting end of each wrench member 20 are respectively provided with key ways 16, 17 which are positioned on a circle, while the bottom surface of the cap member 40 is integrally formed with keys 43 to engage with the keys ways 16, 17.

Furthermore, a headed bolt 50 having a threaded end 51 is inserted into the hole 42 on the cap member 40 through an opening 29 formed at the center of the coupling member 10 and the lower end thereof has a nut 60 screwed thereon. The tightness of attachment of the cap member 40 against the coupling member 10 can be adjusted by rotating the nut 60. In order to prevent the bolt 50 from rotating with the nut 60, an additional key 52 is provided on the bottom surface of the head of bolt 50 and an additional key way 45 is correspondingly provided on the cap member 40.

When the wrench is to be used, the wrench members 20 are pivoted to become straight, and then each is pushed forward to align the key ways 17 thereon with the key ways 16 on the coupling member 10. After loosening the nut 60, the cap member 40 is rotated to a position where the keys 43 engages with the key ways 17 and then the nut 60 is rotated to tighten the coupling member 10 again thereby securing the wrench member 20 in its stretched position to be ready for use.

Figure 2:
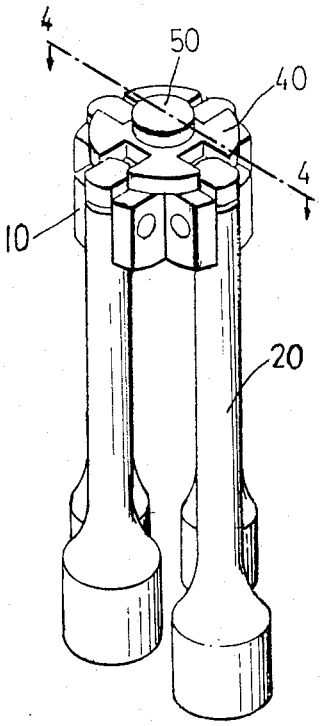
FIG. 2 is a perspective view of the foldable cross wrench in a folded position.

After using, the wrench member 20 can be folded to parallel each other, as shown in FIG. 2, by firstly loosening the nut 60, then rotating the cap member 40 through a right angle to a position where the keys 43 engage with the key ways 16 and the notches 41 align with the channels 12. The wrench member 20 may now be pivoted down to a folded position.

The edges of walls of the coupling member 10 which hold the wrench member 20 are preferably rounded to decrease the degree of stress concentrated, therefore, the strength of the coupling member 10 is improved.

While the invention has been described in connection with what is presently considered to the most practical and preferred embodiment it is to be understood that the invention is not to be limited to the disclosed embodiment but on the contrary, is intended to cover various modifications and equivalent arrangements included within the spirit and scope of the appended claims which scope is to be accorded the broadest interpretation so as to encompass all such modifications and equivalent structure.

What I claim is:

1. A foldable cross socket wrench comprising: a coupling member including a rigid block which is quartered into four sections, each two sections spaced apart with a slot, the top surface of each said sections being provided a first key way, positioned in a circle four wrench members each having a working head at a first end and a second end pivoted to said coupling member between two adjacent sections and received in said slot, said second end being provided with a second key way constituting a circular key way with said first key ways when said wrench members are in stretched position; a cap member releasably attached to said coupling member and provided with key elements on the bottom surface thereof for locking said wrench members in said stretched position by engaging with said second key ways, said cap also having slots for receiving the wrench members to release said wrench members as said cap member is rotated through a predetermined angle to a position where said key elements engage with said first key ways; and means for adjustably fastening said cap member in place whereby the tightness of engagement of said cap member against said coupling member can be adjusted.

2. A foldable cross socket wrench as claimed in claim 1, wherein said wrench member are provided with an extended bore at said pivoting end for receiving a pin to pivot on said coupling member and permit limited longitudinal movement with respect to said coupling member.

3. A foldable cross socket wrench as claimed in claim 1, wherein said means for adjustably fastening said cap member comprises a headed bolt having a threaded end, that passes through said cap member and said coupling member, the threaded end having a nut screwed thereon.

4. A foldable cross socket wrench as claimed in claim 3, wherein said cap member is provided with a third key way on the upper surface thereof and said headed bolt is correspondingly provided with a third key on the bottom surface of the head for preventing said headed bolt from rotating together with said nut when said nut is rotated.

* * * * *